US005398622A

United States Patent [19]

Lubinskas et al.

[11] Patent Number: 5,398,622

[45] Date of Patent: Mar. 21, 1995

[54] ADJUSTABLE DUAL WORKSURFACE SUPPORT

[75] Inventors: Robert B. Lubinskas, Hastings; Timothy H. Schipper, Grand Rapids; Roger E. Doane, Jenison; Jeffrey A. Musculus, Wyoming, all of Mich.

[73] Assignee: Steelcase Inc., Grand Rapids, Mich.

[21] Appl. No.: 250,869

[22] Filed: May 31, 1994

Related U.S. Application Data

[63] Continuation of Ser. No. 158,717, Nov. 26, 1993, abandoned, which is a continuation of Ser. No. 774,455, Oct. 10, 1991, abandoned.

[51] Int. Cl.[6] ..... A47B 23/00

[52] U.S. Cl. ..... 108/145; 108/3; 248/281.1

[58] Field of Search ..... 108/147, 145, 138, 3, 108/7, 10, 9; 248/281.1, 188.2, 188.5; 100/50

[56] References Cited

U.S. PATENT DOCUMENTS

| | | | |
|---|---|---|---|
| 256,583 | 4/1882 | Merrill . | |
| D. 315,462 | 3/1991 | Grout | D6/491 |
| D. 316,786 | 5/1991 | Grout | D6/491 |
| 2,541,075 | 2/1951 | Koch | 312/28 |
| 2,649,345 | 8/1953 | Hubbard | 311/39 |
| 2,890,010 | 6/1959 | Barkheimer | 248/157 |
| 3,080,835 | 3/1963 | Guglielmi | 108/116 |
| 3,285,207 | 11/1966 | Heinz-Gunther Muller Vom Hagen | 108/144 |
| 3,425,761 | 2/1969 | Schreyer | 312/28 |
| 3,565,372 | 2/1971 | Jones et al. | 248/2 |
| 3,710,735 | 1/1973 | Litvinoff et al. | 108/146 |

(List continued on next page.)

FOREIGN PATENT DOCUMENTS

| | | |
|---|---|---|
| 2320344 | 11/1974 | Germany . |
| 3314388 | 6/1984 | Germany . |
| 56-53940 | 5/1981 | Japan . |
| 162738 | 11/1982 | Japan . |
| 60-77426 | 5/1985 | Japan . |
| 60-163040 | 10/1985 | Japan . |
| 60-180029 | 11/1985 | Japan . |
| 0010491 | 10/1979 | United Kingdom . |
| 2081080 | 4/1982 | United Kingdom . |

OTHER PUBLICATIONS

Magnetic Actuators System 3010 (2 pages) (Pub. date unknown).

NKR Environments Ltd. (8 pages) (Pub. date unknown).

IBM Synergetix Furniture (26 pages) 1981.

GMA HEFT 41 vom 12.10 1978 (1 page) Oct. 12, 1978.

Division A4 (2 pages) Sep. 18, 1969; pp. 170 & 171.

*Primary Examiner*—Jose V. Chen

*Attorney, Agent, or Firm*—Price, Heneveld, Cooper, DeWitt & Litton

[57] ABSTRACT

A dual worksurface support is provided for electronic data processing equipment and the like, and includes two separate worksurfaces adapted to support different pieces of equipment thereon. The worksurfaces are interconnected by a linkage assembly which permits vertical adjustment of one of the worksurfaces with respect to the other, and includes left and right hand linkages located at the opposite sides of the respective worksurfaces, which rotate about at least one horizontal pivot axis. A rigid stabilizer bar has its opposite ends fixedly connected with the two linkages at locations concentric with the horizontal pivot access, such that rotation of one of the linkages is transmitted through the stabilizer bar to the other linkage to ensure that the opposite sides of the adjusted worksurface move vertically together without sagging or binding. A releasable lock may be connected with the stabilizer bar to retain the adjusted worksurface at selected heights, and telescoping pedestal may be provided with a quick disconnect actuator mount which permits replacement of the actuator without disassembly of the pedestal.

27 Claims, 3 Drawing Sheets

U.S. PATENT DOCUMENTS

| | | | |
|---|---|---|---|
| 3,765,676 | 10/1973 | Bearson et al. | 273/1.5 R |
| 3,778,125 | 12/1973 | Gutmann, Jr. et al. | 312/272.5 |
| 3,877,667 | 4/1975 | Monckton | 248/4 |
| 3,999,733 | 12/1976 | Harder, Jr. | 248/400 |
| 4,373,334 | 2/1983 | Carlander | 60/594 |
| 4,381,714 | 5/1983 | Hennberg et al. | 108/147 |
| 4,403,760 | 9/1983 | Alvermann | 248/284 |
| 4,550,666 | 11/1985 | Svoboda | 108/96 |
| 4,616,798 | 10/1986 | Smeenge et al. | 248/281.1 |
| 4,632,349 | 12/1986 | Anstey | 248/281.1 |
| 4,651,652 | 3/1987 | Wyckoff | 108/144 |
| 4,667,605 | 5/1987 | Bastian | 108/144 |
| 4,691,886 | 9/1987 | Wendling et al. | 248/183 |
| 4,706,919 | 11/1987 | Soberalski | 248/281.1 |
| 4,708,312 | 11/1987 | Rohr | 248/280.1 |
| 4,711,184 | 12/1987 | Wallin et al. | 108/144 |
| 4,747,353 | 5/1988 | Watt | 108/146 |
| 4,751,884 | 6/1988 | Ball | 108/144 |
| 4,768,744 | 9/1988 | Leeds et al. | 248/280.1 |
| 4,779,922 | 10/1988 | Cooper | 297/188 |
| 4,826,123 | 5/1989 | Hannah et al. | 248/248 |
| 4,836,478 | 6/1989 | Sweere | 248/1 E |
| 4,843,978 | 7/1989 | Schmidt et al. | 108/138 |
| 4,850,563 | 7/1989 | Grout | 248/422 |
| 4,852,842 | 8/1989 | O'Neill | 248/280.1 |
| 4,880,270 | 11/1989 | Cooper | 297/188 |
| 4,898,103 | 2/1990 | Pontoppidan et al. | 108/144 |
| 4,920,458 | 4/1990 | Jones | 362/33 |
| 4,974,808 | 12/1990 | Ball | 248/917 |
| 4,988,066 | 1/1991 | Cotterill | 248/281.1 |
| 5,005,492 | 4/1991 | Ogino et al. | 108/145 |

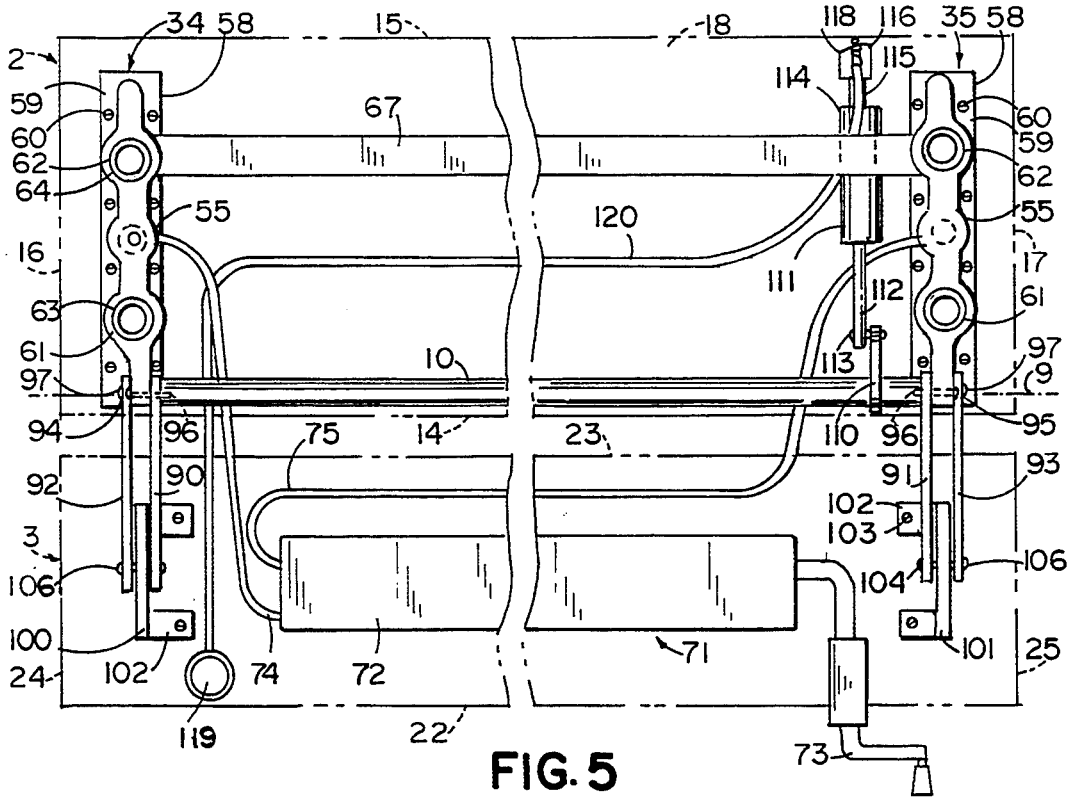
FIG. 5
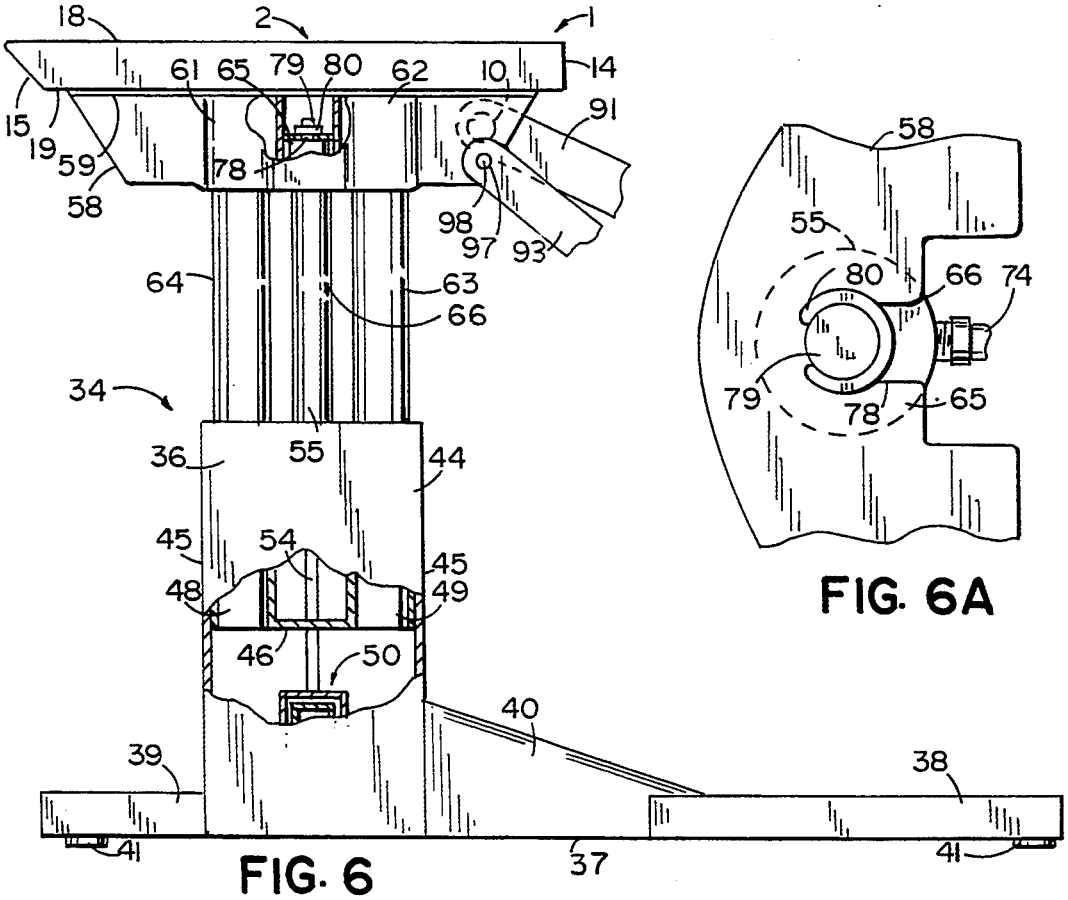
FIG. 6
FIG. 6A

ADJUSTABLE DUAL WORKSURFACE SUPPORT

This is a continuation of prior application Ser. No. 08/158,717, filed on Nov. 26, 1993, now abandoned, which is a continuation of prior application Ser. No. 07/774,455, filed on Oct. 10, 1991, (now abandoned).

BACKGROUND OF THE INVENTION

The present invention relates to furnishings for electronic data processing equipment and the like, and in particular to an adjustable dual worksurface support therefor.

Electronic data processing equipment such as personal computers, communications monitors, workstation terminals, etc. have become an important part of modern offices. Many different types of specialized furniture have already been developed to support such equipment. However, heretofore, computer furniture has typically been either quite massive in construction, with associated high costs and maintenance problems, or relatively lightweight with limited adjustability, stability, and durability.

SUMMARY OF THE INVENTION

One aspect of the present invention is a dual worksurface support for electronic data processing equipment and the like. First and second worksurfaces are provided to support different pieces of equipment thereon, and are interconnected by a linkage assembly which permits vertical adjustment of one worksurface with respect to the other. The linkage assembly includes left and right hand linkages located at the opposite sides of the respective worksurfaces, which rotate about at least one horizontal pivot axis. A rigid stabilizer bar has its opposite ends fixedly connected with the left and right hand linkages at locations concentric with the horizontal pivot axis, such that rotation of one of the linkages is transmitted through the stabilizer bar to the other linkage to ensure that the opposite sides of the adjusted worksurface move vertically together without sagging or binding.

Yet another aspect of the present invention is to provide a vertically adjustable worksurface support for electronic data processing equipment and the like, comprising a worksurface supported freestanding on a floor by a pedestal arrangement. The pedestal arrangement includes a vertically telescopingly portion, with a linear actuator positioned therein to raise and lower the worksurface with respect to the floor. A quick disconnect mount detachably connects one end of the linear actuator with the worksurface in a manner which is accessible from the exterior of the worksurface, and includes a latch which detachably connects the opposite end of the linear actuator with the pedestal, and includes a manually actuated release accessible from an exterior portion of the pedestal, whereby the linear actuator may be readily removed from the worksurface support and replaced without requiring disassembly of the telescopingly portion of the pedestal.

The principle objects of the present invention are to provide a worksurface support for electronic data processing equipment and the like, which is stable, relatively lightweight, and readily adjustable to many different convenient heights. The dual worksurface arrangement permits two different pieces of electronic data processing equipment to be independently adjusted to more closely suit the needs of a variety of different users. The worksurfaces can be made relatively wide to accommodate various equipment and tasks, and a stabilizer bar provides secure support by preventing sagging or binding during vertical adjustment. The support preferably includes a freestanding pedestal with a telescopingly portion that simultaneously raises and lowers both worksurfaces. A unique mounting arrangement is provided for the pedestal actuator, which permits the actuator to be easily removed from the pedestal and replaced without disassembly of the telescopingly portion of the pedestal. The worksurface support has a rather uncomplicated design, with associated reduced manufacturing costs, and can be easily operated by all types of personnel. The dual worksurface support is efficient use, capable of a long operating life, and particularly well adapted for the proposed use.

These and other advantages of the invention will be further understood and appreciated by those skilled in the art by reference to the following written specification, claims, and appended drawings.

BRIEF DESCRIPTION OF THE DRAWINGS

FIG. 5 is a top-plan view of the dual worksurface support, shown with both worksurfaces removed.

FIG. 6 is a fragmentary, side elevational view of the dual worksurface support, shown with portions thereof broken away to reveal internal construction.

FIG. 6A is a fragmentary, top plan view of a pedestal actuator mount.

DETAILED DESCRIPTION OF THE PREFERRED EMBODIMENTS

Figure 1:
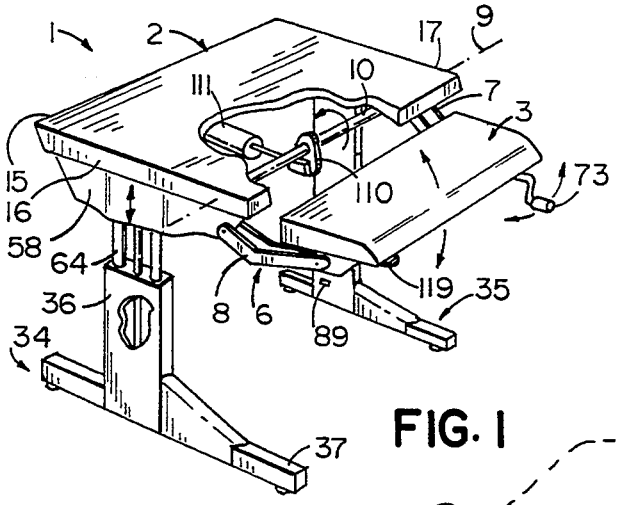
FIG. 1 is a perspective view of an adjustable dual worksurface support embodying the present invention, with portions thereof broken away to reveal internal construction.

For purposes of description herein, the terms "upper", "lower" "right" "left" "rear" "front", "vertical", "horizontal", and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of inventive concepts defined in the appended claims. Hence, specific dimensions and other physical characteristics relating to the embodiments disclosed herein are not to be considered as limiting, unless the claims expressly state otherwise.

The reference numeral 1, (FIGS. 1 & 2) generally designates an adjustable dual worksurface support, embodying the present invention. Dual worksurface support 1 is particularly adapted for use in conjunction with electronic data processing equipment and the like, and includes two separate worksurfaces 2 and 3, which are designed to support different pieces of equipment thereon, such as the schematically illustrated terminal 4 and keyboard 5. Worksurfaces 2 and 3 are interconnected by a linkage assembly 6, which permits vertical adjustment of one worksurface with respect to the other. Linkage assembly 6 includes right and left-hand linkages 7 and 8 respectively located at the opposite sides of worksurfaces 2 and 3, which rotate about at least one horizontal pivot axis 9. A rigid stabilizer bar 10 has its opposite ends fixedly connected with the two linkages 7 and 8 at a location concentric with the horizontal pivot axis 9, such that rotation of one of the linkages is transmitted through stabilizer bar 10 to the other linkage to ensure that the opposite sides of the adjusted worksurface move vertically together without sagging or binding.

The illustrated terminal worksurface 2 (FIGS. 5 & 6) has a substantially rectangular plan configuration, comprising a front edge 14, a rear edge 15, and opposite side edges 16 and 17. Terminal worksurface 2 includes substantially planar, mutually parallel, upper and lower surfaces 18 and 19 respectively, and is substantially rigid to securely support different types of equipment thereon, such as the illustrated computer terminal 4. In the illustrated example, terminal worksurface 2 is constructed from a high density particle board core, with a durable exterior finish, such as a high pressure laminate, special mar-resistant coated paints, or the like. The rear edge 15 of terminal worksurface 2 is inclined forwardly, while the remaining edges 14 and 16 & 17 are oriented substantially perpendicular to the opposite faces 18 and 19 of worksurface 2.

The illustrated keyboard worksurface 3 (FIGS. 5 & 6) is similar to terminal worksurface 2, and in the illustrated example has a substantially rectangular plan configuration, comprising a front edge 22, a rear edge 23, and opposite side edges 24 and 25. The upper and lower surfaces 26 and 27 (FIG. 2) respectively of keyboard worksurface 3 are substantially planar and parallel, except for an inclined forward portion 28 of upper surface 26, which is adapted to provide wrist support for the keyboard operator. Keyboard worksurface 3 is substantially rigid, and preferably has a construction and finish similar to terminal worksurface 2. In the illustrated example, keyboard worksurface 3 is relatively wide, having a width substantially equal to that of terminal worksurface 2, with a slightly smaller depth, which is shaped to accommodate thereon a conventionally sized computer keyboard, such as the illustrated keyboard 5.

Figure 2:
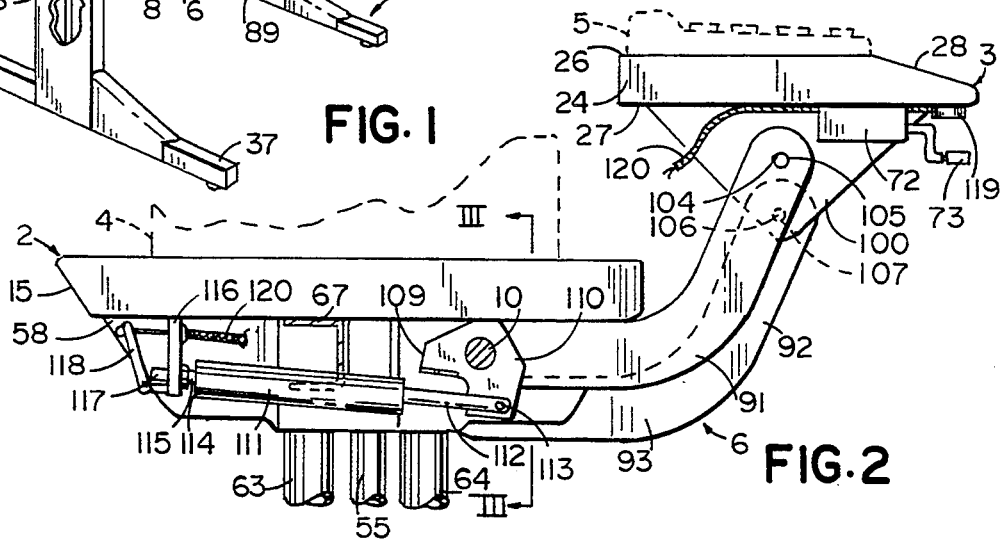
FIG. 2 is a vertical cross-sectional view of the dual worksurface support, shown with a keyboard support portion thereof in a fully raised position.

The dual worksurface support 1 shown in FIGS. 1 & 2 includes a pair of vertically adjustable legs or pedestals, 34 and 35, which support worksurfaces 2 and 3 freestanding on the floor surface of an associated building or the like. Pedestals 34 and 35 have their upper ends attached to the lower surface 19 of terminal worksurface 2 adjacent the left and right side edges 16 and 17 of terminal worksurface 2 to provide substantial kneespace under worksurfaces 2 and 3. Pedestals 34 and 35 have a substantially identical construction, such that for ease of description herein, reference will be had only to the left-hand pedestal 34, it being understood that the right-hand pedestal 35 is substantially identical.

As best illustrated in FIGS. 5 and 6, pedestal 34 has a rectangular base 36 with an elongate foot 37 attached along the lower portion thereof. Pedestal foot 37 includes a forward portion 38, a rearward portion 39, and an inclined portion 40 positioned between forward portion 38 and base 36. A second inclined portion (not shown) may be positioned between base 36 and rearward portion 39 for increased structural strength and style symmetry. Glides 41 are attached to the bottom of foot 37, and facilitate non-marring abutment with the supporting floor surface. Base 36 has a hollow interior defined by two pairs of sidewalls 44 and 45 arranged in a generally rectangular plan configuration. A guide block 46 is mounted in the upper end of pedestal base 36, and includes a pair of tube guides 48 and 49 oriented substantially vertically therein adjacent opposite base sidewalls 45. A cylinder rod retainer assembly 50 is positioned in the lower end of pedestal base 36, and is adapted to retain the rod end 54 of an associated actuator cylinder 55, as described in greater detail hereinafter.

The upper end of pedestal 34 (FIGS. 5 & 6) includes a cantilever bracket 58, with outwardly extending upper flanges 59 attached to the lower surface 19 of terminal worksurface 2 by threaded fasteners 60. Cantilever bracket 58 includes a pair of cylindrically shaped, vertically oriented sockets 61 and 62 in which mating guide tubes 63 and 64 are received and securely mounted. Guide tube 63 and 64 are positioned in a fore-to-aft spaced apart relationship, are rigid, and include a smooth exterior surface that is closely received within the tube guides 48 and 49 of pedestal base 36, so as to telescope smoothly therein. Cantilever bracket 58 also includes a cylinder mounting plate 65 (FIG. 6A) extending between sockets 61 and 62 on the interior side of bracket 58, in which the cylinder end 66 of actuator cylinder 55 is received and detachably mounted in the manner described below. A C-shaped, rearwardly opening reinforcing channel 67 (FIGS. 5 & 6) has its opposite ends connected with cantilevered brackets 58 at rearward portions thereof, and is attached to the lower surface 19 of terminal worksurface 2 to rigidify and strengthen the same.

In the illustrated example, the actuator cylinders 55 (FIGS. 5 & 6) associated with pedestals 34 and 35 are single acting hydraulic cylinders which are part of an integrated hydraulic drive package or unit 71. Hydraulic drive unit 71 also includes a hydraulic pump 72, which is operatively connected with both cylinders 55 by hydraulic lines 74 and 75. The illustrated pump 72 is mounted on the lower surface 27 of keyboard worksurface 3, and includes a manual crank 73 which projects from the front edge 22 of keyboard worksurface 3 at the right side thereof to facilitate access and manual rotation by the user. Hydraulic lines 74 and 75 are preferably routed along outside linkage arm 92 to avoid interference with linkage assembly 6, and connect pump 72 with the hydraulic cylinders 55 in pedestals 34 and 35 in a manner so that both cylinders 55 extend and retract simultaneously upon manipulation of crank 73.

It is to be understood that while the illustrated pump 72 is manually actuated by crank 73, crank 73 may be replaced by an electric motor (not shown) or another suitable power source to extend and retract cylinders 55. In such case, pump crank 73 is replaced by an electronic control pad (not shown) on the upper surface 28 of keyboard worksurface 3.

With reference to FIGS. 6 and 6A, the upper or cylinder end 66 of each actuator cylinder 55 is mounted in cantilever bracket 58 in the following fashion. The cylinder mounting plate 65 associated with cantilever bracket 58 includes a U-shaped, laterally extending aperture 78 which opens toward the interior of dual worksurface support 1. A mounting pin 79 extends upwardly from the longitudinal central axis of cylinder 55, and is closely received in the U-shaped aperture 78 of mounting plate 65. A snap ring 80 is received in a mating annular groove adjacent the free end of mounting pin 79. Snap ring 80 has an outside diameter slightly larger than the width of the U-shaped aperture 78 in mounting plate 77, so as to positively prevent the cylinder end 66 of actuator cylinder 55 from being inadvertently removed from cantilever bracket 58. The upper end of actuator cylinder 55 normally abuts the lower surface of mounting plate 77 to support thereon worksurfaces 2 and 3, as well as any associated equipment. Cylinder mounting plate 65 is open on the interior side of cantilever bracket 58 to provide access to snap ring 80 for replacing actuator cylinder 55, as discussed more fully below.

Figure 7:
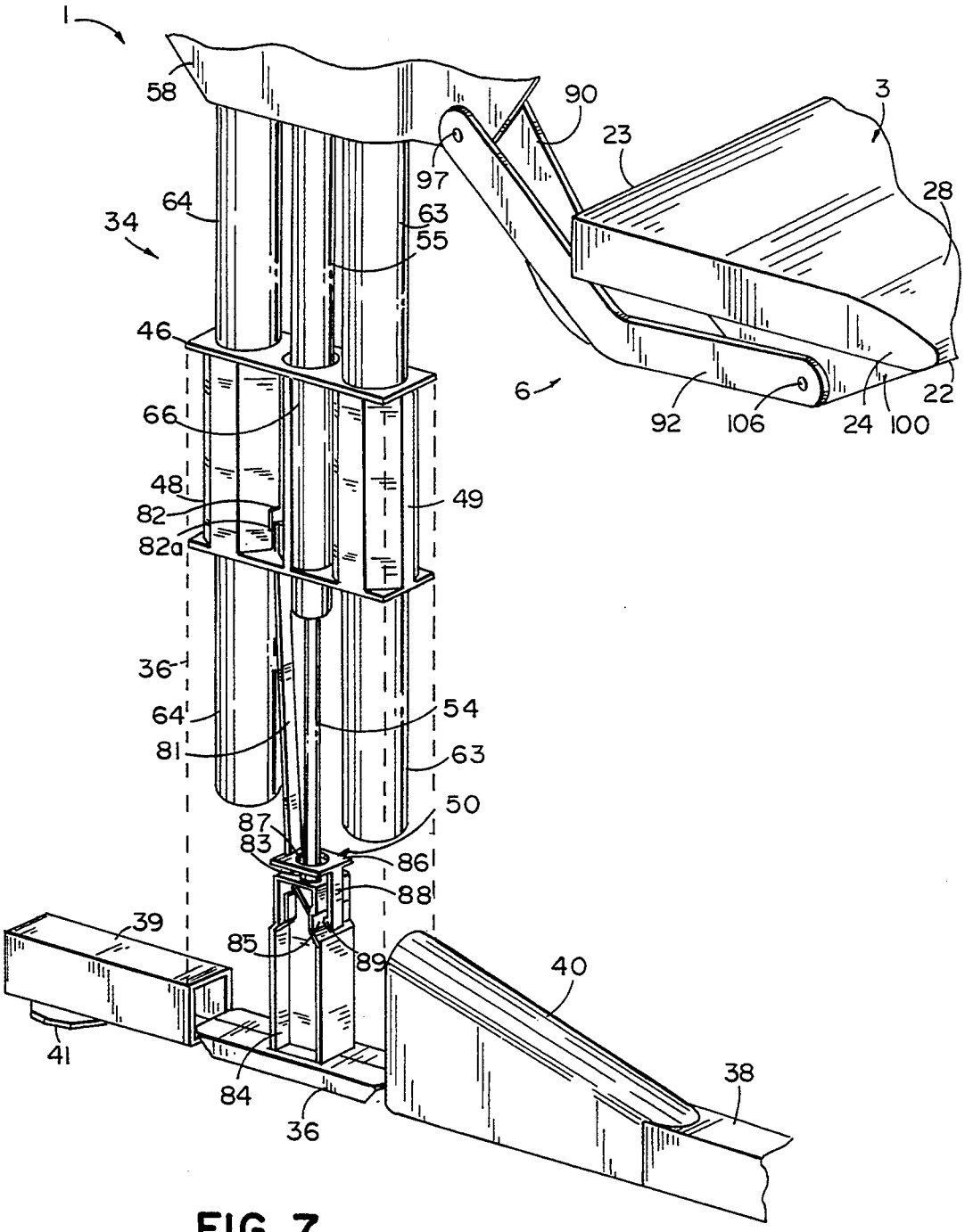
FIG. 7 is a fragmentary perspective view of a pedestal portion of the dual worksurface support, with a cover therefor removed to expose internal construction.

The lower or rod end 54 (FIG. 6) of actuator cylinder 55 is retained in pedestal 34 in the following fashion. As best illustrated in FIG. 7, an upstanding, stationary support column 84 is fixedly mounted on the base 36 of pedestal 34, and includes a pair of barb-shaped grooves 85 along the forward and rearward faces thereof. Cylinder rod retainer assembly 50 comprises a horizontal retainer plate 86, having a vertically oriented, centrally located, frustro-conically shaped cup or socket 87 configured to receive the lower, free end of actuator rod 54 therein, as shown in FIG. 7. Retainer plate 86 also includes a pair of latch arm 88 extending downwardly from the forward and rearward edges thereof, adjacent the forward and rearwards faces of stationary support column 84, and serve to capture the same therebetween in a manner which permits retainer plate 86 to move vertically along stationary support column 84. Latch arms 88 have inwardly facing barbs 89 at their free ends which selectively engage the grooves 85 in support column 84 to define a predetermined amount of vertical travel permitted between retainer plate 86 and stationary support column 84. A lock bar 81 is provided to prevent pedestals 34 and 35 from being inadvertently disassembled, and has its lower end connected with retainer plate 86 adjacent the rearward edge thereof, and its upper end projecting through the base of guide block 46. The upper end of lock bar 81 includes an inclined cam 82 with a friction pad 82a, such as rubber, or the like, mounted on the interior side thereof, which is positioned to selectively abut the exterior surface of adjacent guide tube 64 to prevent telescoping motion between guide tubes 63 & 64 and associated pedestal base 36. A coil spring 83 is positioned between the upper surface of support column 84 and the lower surface of retainer plate 86, and is normally compressed therebetween by the weight of worksurfaces 2 and 3, as well as any associated equipment supported thereon. When coil spring 83 is in its normally compressed condition, cam 82 and associated friction pad 82a on the upper end of lock bar 81 are spaced apart or disengaged from the associated adjacent guide tube 64. When weight is removed from coil spring 83, such as when dual worksurface support 1 is picked up by one of the worksurfaces 2 & 3, coil spring 83 lifts retainer plate 86 and attached lock bar 81 upwardly, causing the friction pad **82*a* on cam 82 to engage adjacent guide tube 64, and thereby lock pedestal base 36 onto guide tubes 63 and 64. Due to the angle of cam 82, as additional upward force is applied to guide tubes 63 and 64, friction pad 82a is urged into engagement with adjacent guide tube 64 with even greater force to create a very secure, self-locking action. As previously noted, both pedestals 34 and 35 are substantially identical, and include an associate lock bar 81 to prevent the same from being pulled apart. This locking action permits both pedestal bases 36 to be lifted up off of the floor surface, without pulling the free ends of cylinder rods 54 out from their mating sockets 87**.

Each pedestal base 36 includes a horizontal slot 89 (FIG. 1) through its interior sidewall 44 at a location generally aligned with the associated retainer plate 86. Slot 89 is sized and configured to permit insertion of a tool therethrough, such as a conventional screwdriver, or the like, to hold retainer plate 86 and attached lock bar 81 and associated cam 82 in a downward, disengaged position, as described below.

In the event some portion of hydraulic drive unit 71, such as a cylinder 55, becomes worn, and must be replaced, the entire drive unit 1 is removed from dual worksurface support 1, and then replaced in the following manner. Pump crank 73 is manipulated so as to move terminal worksurface 2 to its lowest position. Screwdrivers or other similar tools (not shown) are inserted through the slots 89 in pedestal bases 36, and then manipulated to hold retainer plates 86 and associated lock bars 81 downwardly, in their unlocked or release position. Terminal worksurface 2 can then manually be lifted upwardly, until cylinders 55 are completely removed from their associated pedestals 34 and 35. Snap rings 80 are removed from mating pins 79, and hydraulic cylinders 55 are then pulled laterally out from the U-shaped apertures 78 in associated cylinder mounting plates 65, until the cylinders 55 are free. Pump 72 is removed from keyboard worksurface 3, such that the entire hydraulic drive unit 71 is disassembled from dual worksurface support 1. A replacement hydraulic drive unit 71, with new cylinders 55 may then be reassembled in pedestals 34 and 35, by simply reversing those steps outlined above. Note cylinder system comes out as an assembly two lift cylinders 55 and pump 72.

Worksurface 2 and 3 (FIGS. 1–4) are interconnected by right and left-hand linkages 7 and 8 in a manner so as to permit vertical adjustment between the two worksurfaces. In the illustrated example, linkages 7 and 8 are located on opposite sides of worksurfaces 2 & 3 adjacent their associated side edges 16 & 24 and 17 & 25 respectively, so as to provide very secure and stable support for even very wide keyboard worksurface 3, while avoiding kneespace interference. The illustrated linkages 7 and 8 are substantially identical, four-bar, parallelogram assemblies, comprising a pair of inside arms 90 and 91, and a pair of outside arms 92 and 93. All of the linkage arms 90-93 have a generally L-shaped side elevational configuration, which permits keyboard worksurface 3 to be raised to a relatively high elevation, while maintaining a low overall profile for linkage assembly 6. Link arms 90-93 permit keyboard worksurface 3 to have a wide range of vertical travel between the uppermost position illustrated in FIG. 2 above terminal worksurface 3, and the lowermost position illustrated in FIG. 4 below terminal worksurface 3. The rearward ends of inside arms 90 and 91 are positioned on the interior sides of associated cantilevered brackets 58, and are pivotally mounted thereto at first and second laterally aligned pivot points 94 and 95, which are aligned with horizontal pivot axis 9. In the illustrated example, pins 96 are provided to pivotally connect inside arms 90 and 91 with their associated cantilever bracket 58. The outside arms 92 and 93 are positioned on the exterior sides of cantilevered brackets 58, and are pivotally attached thereto by pins 97, which define pivot points 98 and 99 located slightly below and vertically aligned with the pivot points 94 and 95 of associated inside arms 90 and 91.

A pair of mounting brackets 100 and 101 (FIG. 5) are provided to pivotally connect the outer ends of arms 90-93 with keyboard worksurface 3. In the illustrated example, mounting brackets 100 and 101 have a generally triangular side elevational configuration, and include a pair of inwardly facing flanges 102 attached to the lower surface 27 of keyboard worksurface 3 by fasteners 103. The outer ends of inside arms 90 and 91 are pivotally mounted to mounting brackets 100 and 101 at a central portion thereof by pins 104 to define pivot points 105. In a similar fashion, the outer ends of outside arms 92 are pivotally attached by pins 106 to mounting brackets 100 and 101 at a position vertically aligned with, and slightly below pivot points 105 to define pivot points 107. Pivot points 94 & 95, 98 & 99 and 105 and 107 are arranged such that each pair of inside and outside arms 90-93 forms a four-bar, parallelogram linkage which retains keyboard worksurface 3 in a substantially horizontal orientation as it is raised and lowered with respect to terminal worksurface 2.

Linkage assembly 6 (FIGS. 1–4) includes stabilizer bar 10 to insure that the left and right-hand sides of keyboard worksurface 3 move vertically together without sagging, binding, or other similar problems. In the illustrated example, stabilizer bar 10 comprises a substantially rigid hollow tube, having its opposite ends fixedly attached to the inside surfaces of inside arms 90 and 91 respectively, concentric with pivot points 94 and 95. Stabilizer bar 10 is horizontally oriented such that its central axis is colinear with the horizontal pivot axis 9 of linkages 8 and 9.

Figure 3:
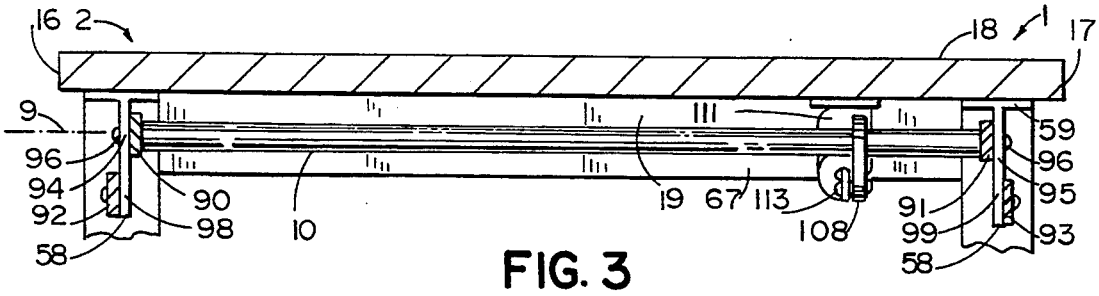
FIG. 3 is a vertical cross-sectional view of the dual worksurface support, taken along the line III—III, FIG. 2.
Figure 4:
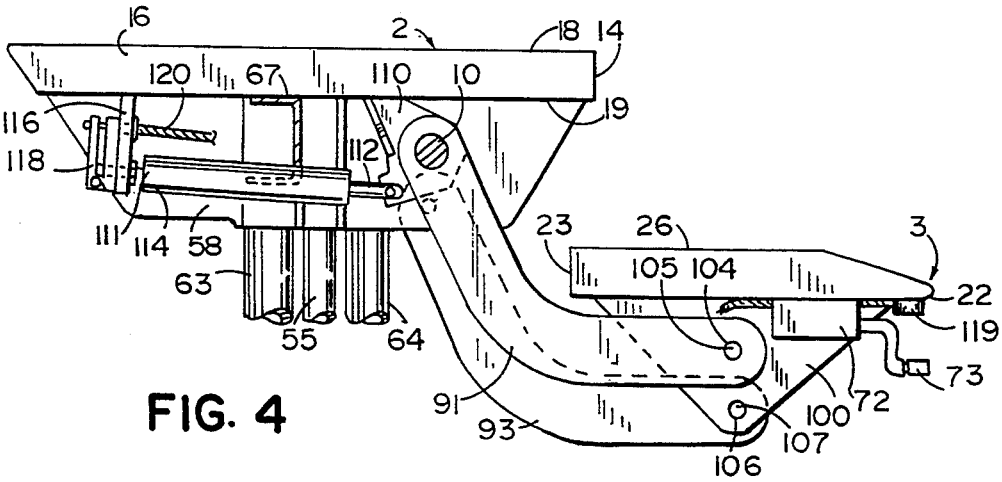
FIG. 4 is a vertical cross-sectional view of the dual worksurface support, shown with the keyboard support in a fully lowered position.

A crank arm 110 (FIGS. 1–4) is fixedly mounted on stabilizer bar 10 for rotation therewith, and in the illustrated example, is disposed adjacent to the right-hand end of stabilizer bar 10 to avoid kneespace interference. As best illustrated in FIGS. 2–4, crank arm 110 has an irregular polygon side elevational configuration, which includes a connector portion 108 and a stop portion 109. When keyboard worksurface 3 is in the fully raised position above terminal worksurface 2, as shown in FIG. 2, the connector portion 108 of crank arm 110 is oriented downwardly, and the upper edges of inside arms 90 and 91 abut the lower surface 19 of terminal worksurface 2 to create a positive upper stop. When keyboard worksurface 3 is in the fully lowered position below terminal worksurface 2, as shown in FIG. 4, the connector portion 108 of crank arm 110 is oriented rearwardly, and the stop portion 109 of crank arm 110 abuts the lower surface 19 of terminal worksurface 2 to create a positive lower stop.

A locking, linear actuator, such as the illustrated gas spring 111 (FIGS. 1–4), is provided to retain keyboard worksurface 3 at selected vertical locations. The illustrated gas spring 111 is a rigid, lockable gas spring, such as a readily available air-over-oil cylinder, and has its body or cylinder end 114 pivotally connected with the connector portion 108 of crank arm 110 by a pin 113. The reciprocating rod 112 of gas spring 111 protrudes rearwardly through a mating aperture in channel 67, and has a rearwardly extending portion pivotally supported in a clevis bracket 116, such that rotation of stabilizer bar 10 causes gas spring 111 to extend and retract. Gas spring 111 also includes an actuator 117 at the rearward end of cylinder rod 112, which is reciprocated by a mating pivot lever 118. A control button 119 is attached to the lower surface 27 of keyboard worksurface 3 at the left-hand side thereof, and is operably connected with gas spring actuator 117 by means such as the illustrated bowden cable 120. Gas spring control button 117 is normally in an extended, locked position (FIG. 2), which prevents rotation of stabilizer bar 10, thereby retaining keyboard worksurface 3 at its selected height. When control button 119 is pressed upwardly, as shown in FIG. 4, pivot lever 118 moves gas spring actuator 117 inwardly to the release position, thereby permitting gas spring 111 to freely extend and retract as keyboard worksurface 3 is raised and/or lowered by the user to its next desired height. Gas spring 111 is pressurized so as to normally biase cylinder rod 112 outwardly, thereby providing a counterbalance force which acts against the weight of keyboard worksurface 3, and any equipment thereon. The gas spring counterbalance force is preferably selected in conjunction with the effective lengths of crank arm 110 and linkage arms 7 and 8, so that when actuator 117 is shifted to the release position illustrated in FIG. 4, keyboard worksurface 3, with a conventional computer keyboard thereon, will not move from its selected position until manually shifted by the operator. Gas spring 111 permits adjustment of keyboard worksurface 3 in substantially infinitely small increments throughout the full range of travel of keyboard worksurface 3.

In operation, dual worksurface 41 can be easily adjusted in the following fashion. The operator first rotates pump crank 73 in a direction which either raises or lowers the computer equipment on terminal worksurface 2 to its desired height. Normally, terminal worksurface 2 is positioned such that a seated user can easily view the screen of an associated display or VDT without adverse light reflections, or the like. Next, the operator adjusts the elevation of keyboard worksurface 3 by manipulating control button 119, then manually adjusting the vertical position of keyboard worksurface 3 to a convenient working height. Stabilizer bar 10 insures that both left and right-hand linkages 7 and 8 move the same amount simultaneously, thereby avoiding any sagging or binding in the movement of keyboard worksurface 3. Stabilizer bar 10 permits the use of very wide worksurfaces 2 and 3, without sacrificing stability, even when heavy, unbalanced loads are positioned on keyboard worksurface 3.

As will be readily appreciated by those skilled in the art, while the illustrated dual worksurface support 1 has two, rectangularly shaped worksurfaces 2 and 3 supported freestanding by a pair of vertically telescoping pedestals 34 and 35, the present invention also contemplates other types of configurations and support arrangements. For instance, dual worksurface support 1 is readily adaptable for corner applications by providing an appropriate pentagon shape for terminal worksurface 2, which could be mounted on a fixed base, panel hung, or otherwise supported.

Dual worksurface support 1 provides stable and secure support for a variety of different types of equipment, and is particularly adapted for electronic data processing equipment, or other similar devices which have two or more separate pieces that can be independently adjusted. Dual worksurface support 1 provides independent vertical adjustment for both of the worksurfaces 2 & 3 throughout a relatively wide range of travel. Dual worksurface support 1 has a relatively lightweight construction, with a detachable cylinder mounting arrangement that permits easy removal and replacement of the actuator cylinders 55, without major disassembly of the unit.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A dual worksurface support for electronic data processing equipment and the like, comprising:

a first worksurface adapted to support a first piece of equipment thereon;

a second worksurface positioned adjacent said first worksurface, and adapted to support a second piece of equipment thereon;

a linkage assembly interconnecting said first and second worksurfaces in a manner which permits said second worksurface to be adjusted vertically with respect to said first worksurface, and including:

a first linkage having one portion thereof connected with one side of said second worksurface, and an opposite portion thereof pivotally connected with a corresponding one side of said first worksurface at a first pivot point for rotation about a preselected horizontal pivot axis;

a second linkage having one portion thereof connected with an opposite side of said second worksurface, and an opposite portion thereof pivotally connected with a corresponding opposite side of said first worksurface at a second pivot point disposed laterally aligned with said first pivot point for rotation about said horizontal pivot axis;

a substantially rigid, elongate stabilizer bar having one end thereof rigidly connected with said first linkage generally adjacent said first pivot point, and an opposite end thereof rigidly connected with said second linkage generally adjacent said second pivot point, whereby rotation of one of said first and second linkages is transmitted through said stabilizer bar to the other of said first and second linkages to insure that the opposite sides of said second worksurface move vertically together without sagging or binding; and wherein said first linkage includes first and second rigid arms arranged in a side-by-side relationship, and having opposite ends thereof pivotally connected with said first and second worksurfaces in an arrangement which defines a first parallelogram linkage; and said second linkage includes first and second rigid arms arranged in a side-by-side relationship, and having opposite ends thereof pivotally connected with said first and second worksurfaces in an arrangement which defines a second parallelogram linkage.

2. A dual worksurface support as set forth in claim 1, wherein:

said second arm of said first parallelogram linkage is positioned laterally inside of said first arm thereof;

said second arm of said second parallelogram linkage is positioned laterally inside of said first arm thereof; and said stabilizer bar has its opposite ends rigidly connected to interior sides of the second arms of said first and second parallelogram linkages.

3. A dual worksurface as set forth in claim 2, including:

a lock releasably locking said second worksurface at a plurality of selected heights.

4. A dual worksurface support as set forth in claim 3, including:

a pedestal connected with said first worksurface for supporting the same freestanding on a floor surface.

5. A dual worksurface support as set forth in claim 4, including:

a vertical adjustment mechanism associated with said pedestal for adjusting the vertical height of said first worksurface above the floor surface.

6. A dual worksurface support as set forth in claim 5, wherein said vertical adjustment mechanism includes:

first and second telescoping leg assemblies positioned adjacent opposite sides of said first worksurface;

first and second linear actuators respectively mounted in said first and second leg assemblies, and adapted to extend and retract the same;

a remote actuator positioned adjacent a forward edge of said second worksurface, and operatively connected with said first and second linear actuators to selectively raise and lower said first and second worksurfaces.

7. A dual worksurface support as set forth in claim 6, wherein said lock comprises:

a linear actuator having opposite ends thereof selectively extending and retracting with respect to one another;

an arm fixedly connected with said stabilizer bar, and having a free end thereof extending radially outwardly from said stabilizer bar; and wherein one end of said linear actuator is pivotally connected with said first worksurface, and the opposite end of said linear actuator is pivotally connected with the free end of said arm.

8. A dual worksurface support as set forth in claim 7, wherein:

said linear actuator and said arm are positioned adjacent one end of said stabilizer bar to avoid kneespace interference.

9. A dual worksurface support as set forth in claim 8, wherein:

said linear actuator includes a remote controller therefor positioned adjacent a forward edge of said second worksurface.

10. A dual worksurface support as set forth in claim 9, including:

a detachable fastening arrangement mounting said linear actuators in said leg assemblies to permit removal and replacement of said linear actuators.

11. A dual worksurface support as set forth in claim 10, wherein:

said one end of said stabilizer bar is connected with said first linkage in a concentric relationship with said first pivot point; and said opposite end of said stabilizer bar is connected with said second linkage in a concentric relationship with said second pivot point.

12. A dual worksurface support as set forth in claim 1, including:

a pedestal connected with said first worksurface for supporting the same freestanding on a floor surface.

13. A dual worksurface support as set forth in claim 12, including:

a vertical adjustment mechanism associated with said pedestal for adjusting the vertical height of said first worksurface above the floor surface.

14. A dual worksurface support as set forth in claim 13, wherein said vertical adjustment mechanism includes:

first and second telescoping leg assemblies positioned adjacent opposite sides of said first worksurface;

first and second linear actuators respectively mounted in said first and second leg assemblies, and adapted to extend and retract the same;

a remote actuator positioned adjacent a forward edge of said second worksurface, and operatively connected with said first and second linear actuators to selectively raise and lower said first and second worksurfaces.

15. A dual worksurface support as set forth in claim 14, including:

a detachable fastening arrangement mounting said linear actuators in said leg assemblies to permit removal and replacement of said linear actuators.

16. A dual worksurface support as set forth in claim 15, wherein:

said linear actuators comprise hydraulic cylinders.

17. A dual worksurface support as set forth in claim 16, including:

a hydraulic pump operably connected with said hydraulic cylinders to extend and retract the same, and mounted on a lower face of said second worksurface.

18. A dual worksurface support as set forth in claim 17, wherein:

said hydraulic pump includes a manual crank extending from the forward edge of said second worksurface.

19. A dual worksurface support as set forth in claim 1, wherein:

said one end of said stabilizer bar is connected with said first linkage in a concentric relationship with said first pivot point; and said opposite end of said stabilizer bar is connected with said second linkage in a concentric relationship with said second pivot point.

20. A dual worksurface as set forth in claim 1, including:

a lock releasably locking said second worksurface at a plurality of selected heights.

21. A dual worksurface support as set forth in claim 20, wherein said lock comprises:

a linear actuator having opposite ends thereof selectively extending and retracting with respect to one another;

an arm fixedly connected with said stabilizer bar, and having a free end thereof extending radially outwardly from said stabilizer bar; and wherein one end of said linear actuator is pivotally connected with said first worksurface, and the opposite end of said linear actuator is pivotally connected with the free end of said arm.

22. A dual worksurface support as set forth in claim 21, wherein:

said linear actuator and said arm are positioned adjacent one end of said stabilizer bar to avoid kneespace interference.

23. A dual worksurface support as set forth in claim 21, wherein:

said linear actuator includes a remote controller positioned adjacent a forward edge of said second worksurface.

24. A dual worksurface support as set forth in claim 21, wherein:

said linear actuator comprises a gas spring.

25. A dual worksurface support as set forth in claim 1, wherein:

said first worksurface comprises a terminal worksurface adapted to support a computer terminal thereon.

26. A dual worksurface support as set forth in claim 1, wherein:

said second worksurface comprises a keyboard worksurface adapted to support a computer keyboard thereon.

27. A dual worksurface support as set forth in claim 1, wherein:

said stabilizer bar comprises a substantially rigid hollow tube.

* * * * *